United States Patent [19]

Loutfy et al.

[11] 4,124,460

[45] Nov. 7, 1978

[54] ELECTROWINNING OF COPPER IN PRESENCE OF HIGH CONCENTRATION OF IRON

[75] Inventors: Raouf O. Loutfy, Pierrefonds; Nanabhai R. Bharucha, Beaconsfield, both of Canada

[73] Assignee: Noranda Mines Limited, Toronto, Canada

[21] Appl. No.: 849,881

[22] Filed: Nov. 9, 1977

[51] Int. Cl.[2] ..... C25C 1/12

[52] U.S. Cl. ..... 204/108; 204/DIG. 9

[58] Field of Search ..... 204/108, DIG. 9

[56] References Cited

U.S. PATENT DOCUMENTS

| | | | |
|---|---|---|---|
| 2,119,936 | 6/1938 | White | 204/108 |
| 3,535,218 | 10/1970 | Brown et al. | 204/108 |
| 3,824,162 | 7/1974 | Sakai et al. | 204/108 |
| 3,864,227 | 2/1975 | Brytczok et al. | 204/108 |
| 3,876,516 | 4/1975 | Pace et al. | 204/108 |

OTHER PUBLICATIONS

"Important Electrochem. Aspects of Electrowinning Cu from Acid Leach Soln's" by T. N. Andersen et al., AIME Intn'l. Symposium on Hydrometallurgy, Chicago, Ill., 2/25-3/1/73, pp. 171-202.

*Primary Examiner*—Richard L. Andrews
*Attorney, Agent, or Firm*—Fleit & Jacobson

[57] ABSTRACT

A process for electrowinning of copper from leach solutions containing a high concentration of iron in the range of about 5 to 40 gpl, is disclosed. The process consists in applying direct current through the solution and periodically reversing the polarity of such current to obtain a solution having a low ferric ion concentration, thereby increasing the operating current efficiency and consequently decreasing the power consumption.

15 Claims, 6 Drawing Figures

ELECTROWINNING OF COPPER IN PRESENCE OF HIGH CONCENTRATION OF IRON

This invention relates to a process for electrowinning copper from leach solutions containing a high iron concentration between about 5 and 40 gpl.

Recovery of copper from relatively dilute solutions such as found in vat or heap leaching of low grade copper oxide ore is normally carried out by cementation on scrap iron. The amount of iron required to cement the copper is usually 2.25 to 3.5 times the stoichiometric quantity, i.e. 2–3 lb of iron is normally consumed to cement 1 pound of copper. This method is, therefore, likely to become less economical as the price of scrap iron continues to increase. Cemented copper also requires further pyrorefining because it contains a high proportion of impurities.

Conventional direct current electrowinning is an alternative method of recovering the copper from the leach electrolytes. However, this method is also known to present serious drawbacks, mainly caused by the presence of iron in the solution, as well as by the relatively low concentration of copper. Problems related to the direct current electrowinning approach are: (1) low operating current efficiencies due to the consumption of part of the current by the oxidation and reduction of iron in solution, (2) localized corrosion of cathode suspension loops due to attack by ferric ions and, (3) inferior quality of the cathode copper deposits. Ways of obviating these problems would render the direct electrowinning of metals, from electrolyte containing iron, substantially more economical than other known methods.

During conventional direct current electrowinning of copper from electrolyte containing iron the predominant reactions at the cathode are:

$$Cu^{2+} + 2e = Cu \quad (1)$$

$$Fe^{3+} + e = Fe^{2+} \quad (2)$$

and at the anode $$H_2O = 2H^+ + \tfrac{1}{2} O_2 + 2e \quad (3)$$

$$Fe^{2+} = Fe^{3+} + e \quad (4)$$

The net effect of electrowinning, therefore, is to diminish the $Cu^{2+}$ content and to increase the acidity of the electrolyte. The cyclic oxidation (reaction 4) and reduction (reaction 2) of iron ($Eo = +0.77$ volt) at the anode and cathode consumes current and is the contributing factor in decreasing the operating current efficiency. At the cathode, the potential is controlled by the copper deposition ($Eo = +0.34$ volt) which is sufficiently low to reduce the ferric ions in solutions, and at the anode the potential is controlled by the oxygen evolution ($Eo = +1.23$ volt) which is sufficiently high to oxidize the ferrous ions back to ferric ions and a steady state condition is reached wherein the concentration of ferric ions is significantly higher than the ferrous ion concentration.

It is generally known as indicated in an article entitled "Important Electrochemical Aspects of Electrowinning Copper From Acid Leach Solutions" published by T. N. Andersen et al in the AIME International Symposium of Hydrometallurgy, Chicago, Ill., Feb. 25–Mar. 1/73 report, pages 171–202, that high concentrations of ferric ions result in low current efficiency and high power consumption, whereas high concentrations of ferrous ions have negligible effect on current efficiency.

Applicant has surprisingly found, in accordance with the present invention, that periodic reversal of direct current during electrowinning of copper from leach solutions containing a high concentration of iron in the range of about 5 to 40 gpl enhances the formation of ferrous ions and establishes an equilibrium with a low ferric ion concentration.

During the forward cycle, reactions, 1 to 4 will take place normally as in the case of conventional direct current electrowinning. However, during the reverse cycle, reactions (1) and (2) will take place at the inert electrode (normally the anode), but only the reverse of reaction (1) (that involving the dissolution of copper) will take place at the copper electrode (normally the cathode), the potential of this electrode being not sufficiently high to oxidize the ferrous ions back to the ferric state. Repeat of this cycle will eventually result in higher concentrations of ferrous ions in solution than under direct current electrolysis conditions. Additionally, the transport and diffusion of ferric ions toward the cathode is likely to be considerably hindered by the preponderance of cupric ions present in the immediate vicinity of the electrode as a result of the application of frequent reversed current.

The usual advantage of using periodic reverse current in metal electrodeposition is mainly that its application leads to the possibility of using higher current densities without increasing the value of cathodic overpotentials to such an extent that other impurities can be co-deposited. Accordingly, it is important to note that the use of periodic reverse current in electrodeposition is restricted to the electrochemical reactions taking place at the cathode only. By contrast, according to the present invention, for metal electrowinning from electrolyte containing high concentrations of iron, it is at the anode, acting as an insoluble, or inert electrode, that the beneficial application of periodic reverse current is directed.

The leach solution is preferably a sulphuric acid solution although the invention may also be carried out with other leach solutions.

The forward and reverse pulse durations may range from 20–200 sec forward and 1–5 sec reverse at a current density of about 10–30 asf in the forward direction and 10–60 asf in the reverse direction. Preferably, the forward and reverse pulse durations are about 160–200 sec forward and 4–5 sec reverse, with forward and reverse current densities of about 15–25 asf and 30–40 asf, respectively. Under these conditions the cycle efficiency is about 90% and above.

The temperature of the solution is maintained between about 25° C. and 65° C., preferably at about 50° C.

Electrowinning may be done in a batch operation wherein the solution is recirculated from a reservoir through an inlet located near the bottom of the cell and allowed to overflow from the top of the cell back to the reservoir until the desired depletion level is achieved.

Electrowinning may also be carried out under continuous flow conditions using a cascade system of cells in which the solution is cascaded from a reservoir through the cascade of cells each having an inlet located near the bottom and an overflow outlet at the top, the depleted solution being collected in a separate reservoir.

The iron concentration in solution is normally in a high ferric state and the ferric ion concentration may be decreased by electrolysis under periodic current reversal conditions to below 4 gpl. The ferric ions in solution may also be reduced to the ferric state, prior to electrolysis, by $SO_2$ or copper powder addition. It has been found that a solution containing a high ferrous ion concentration can be maintained in the high ferrous state if periodic current reversal is used as compared to high rates of conversion to the ferric state when direct current electrolysis is used.

In the above mentioned batch and continuous operations, the electrowon copper produced during electrolysis at low copper concentration is usually in a powder form. Such copper powder may advantageously be recycled and mixed with the feed solution to remove the impurities such as selenium and tellurium from the solution and to reduce the ferric ion concentration to the ferrous state prior to electrolysis.

The invention will now be disclosed, by way of example, with reference to the accompanying drawings in which.

Figure 1:
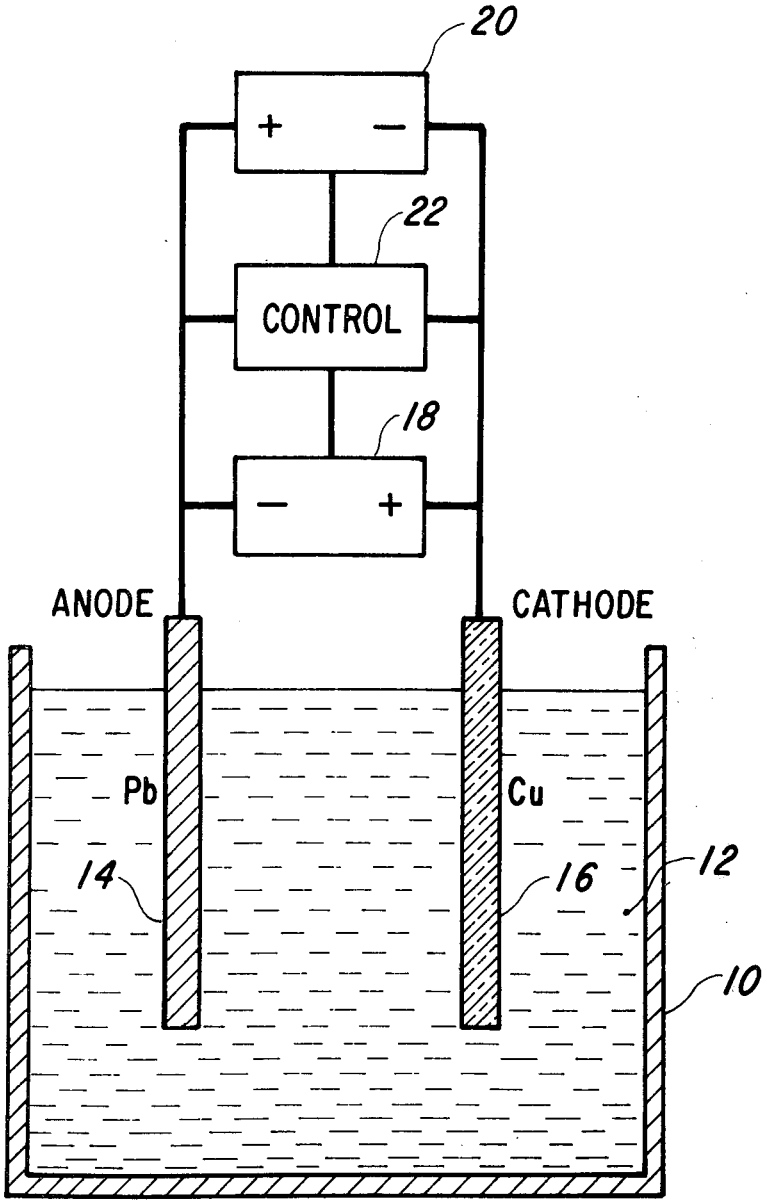
FIG. 1 illustrates a schematic diagram of an electrochemical cell used for carrying out the invention.

Referring to FIG. 1, there is shown a schematic diagram of an electrochemical cell 10 filled with a leach solution 12 containing copper and a high concentration of iron. An anode 14, generally made of inert metal such as lead, and a cathode 16, generally made of copper, are suspended in the solution. Two direct current sources 18 and 20 of opposite polarities are connected to the electrodes 14 and 16. The operation of the cell is controlled by control block 22 which is connected to current sources 18 and 20.

The apparatus operates as follows:

For example, for a time duration of 40 sec, source 18 is connected to electrodes 14 and 16. During this period of time, reactions (1) and (2) described above will take place at the cathode and reactions (3) and (4) will take place at the anode. Thus, there is deposition of copper and formation of ferrous ions at the cathode while ferric ions and evolution of oxygen are produced at the anode. The polarity of the current flowing through the solution is then abruptly reversed by control block 22 which disconnects source 18 and connects source 20 to the electrodes 14 and 16 for a short period of time of say 2 sec. During this short period of time, reactions (1) and (2) will take place at the anode 14 but, as mentioned previously, only the reverse of reaction (1) (that involving the dissolution of copper) will take place at the cathode 16 since the potential of this electrode (0.34v) is not high enough to oxidize the ferrous ions back to their ferric state. The control 22 will then disconnect current source 20 and switch back source 18 and the cycle will be repeated continuously. This will eventually result in a higher concentration of ferrous ions in solution and a lower concentration of ferric ions, typically below 4 gpl. Since the ferrous ions have negligible effect on the current efficiency of the cell, the efficiency will be increased and the power consumption decreased.

The invention will now be disclosed with reference to various experiments done under batch and continuous operations.

1. Batch Operation

EXAMPLE I

Electrolyte Containing High Ferric Ion Concentration

Figure 2:
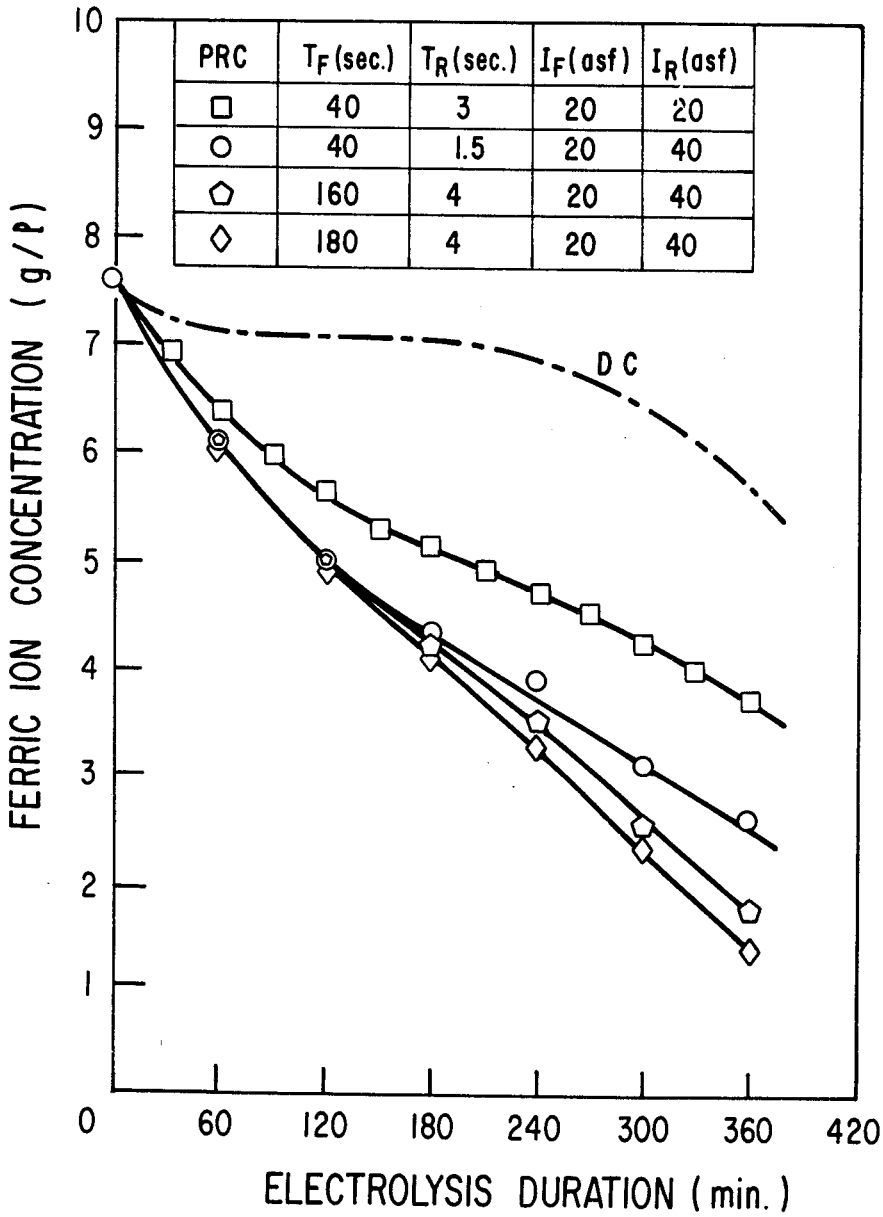
FIG. 2 illustrates the effect of periodic reverse current on the reduction of ferric ion in electrowinning of copper.
Figure 3:
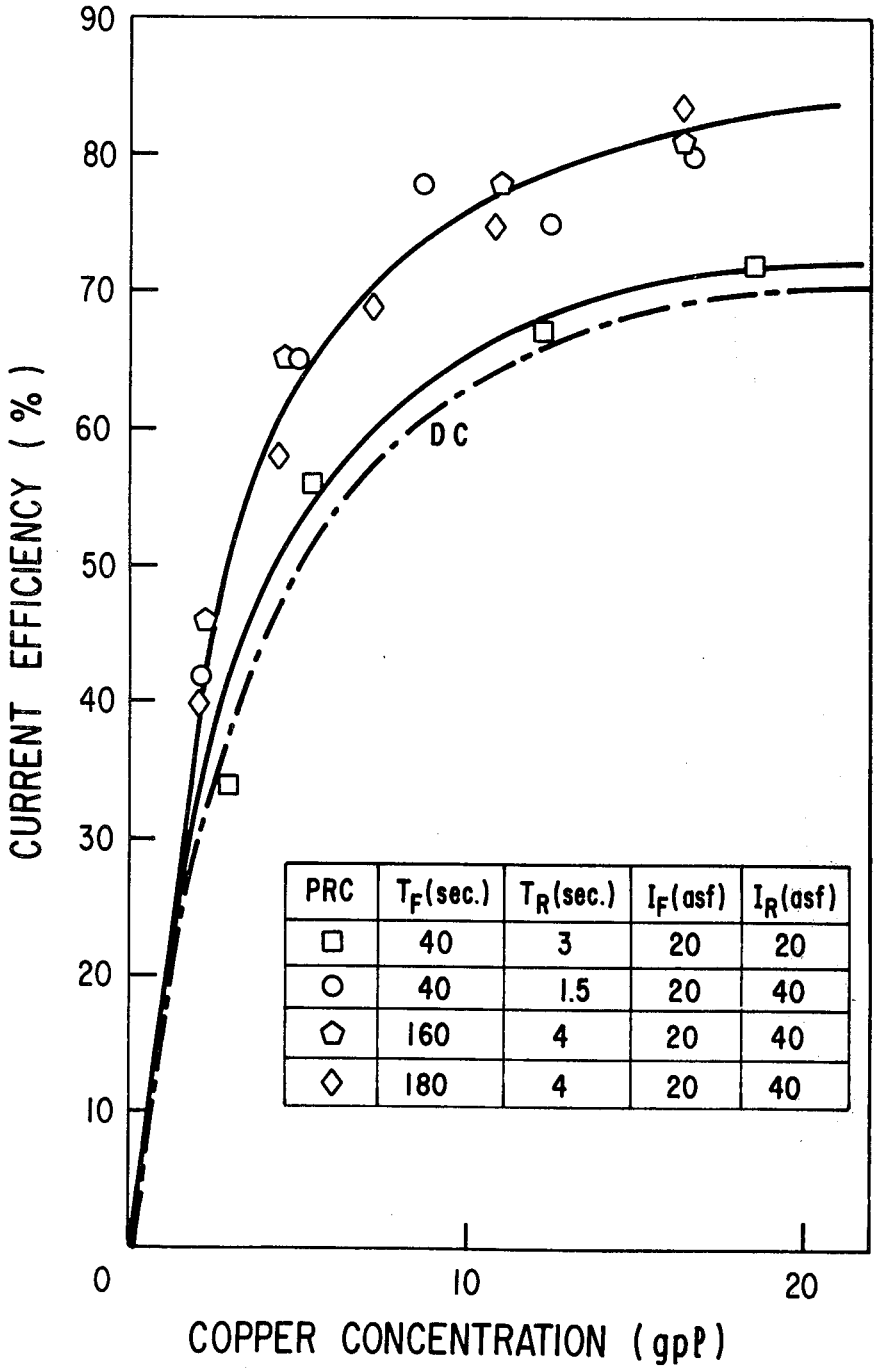
FIG. 3 illustrates the effect of periodic reverse current electrolysis on the current efficiency of copper electrowinning from an electrolyte containing 10 gpl iron.

Decopperization experiments were carried out with an electrolyte containing a high proportion of ferric ions to determine the effect of periodic reverse current (PRC) electrolysis on the ferric ion concentration and on the current efficiency. The electrolyte contained 20 gpl Cu, 10 gpl Fe (80% as ferric ion) and 2.5 gpl sulfuric acid corresponding to a pH of 1.8. The experiments were carried out using a rectangular cell of 700 ml capacity, having two lead anodes mounted on opposite walls of the cell and a copper cathode located centrally to the anodes. The electrolyte was circulated from a reservoir, through an inlet located near the bottom of the cell and allowed to overflow from the top of the cell back to the reservoir. The copper, ferric ion and total iron contents were monitored from samples removed at regular intervals from the reservoir. The electrolyte circulation rate was maintained at 200 ml/m, while decopperization occurred at a temperature of about 30°-32° C. from 20 gpl to about 1 gpl. The results of the tests conducted under both PRC and direct current conditions are shown in FIGS. 2 and 3 and summarized in the following Table I:

TABLE I

RESULTS OF ELECTROLYSIS EXPERIMENT FOR COPPER ELECTROWINNING FROM ELECTROLYTE CONTAINING HIGH CONCENTRATION OF IRON

| Electrolysis Type | Electrolysis Conditions: Density(ast) $I_f$ | $I_r$ | Durations(sec) $T_f$ | $T_r$ | Initial Electrolytic Composition in gpl: Cu | $Fe^{2+}$ | $Fe^{3+}$ | Ferric Equilibrium Conc. in gpl | Average Current Efficienc. for decopperization from 20 to 1(gpl) | 10 to 1(gpl) | Average Cell Voltages (volts) | Power Consump. in kwh/lb for decopperization from 20 to 1(gpl) | 10 to 1(gpl) |
|---|---|---|---|---|---|---|---|---|---|---|---|---|---|
| DC | 20 | — | — | — | 20 | 7.6 | 2.4 | 6.3 | 58.5 | 49.1 | 3.13 | 2.05 | 2.44 |
| PRC | 20 | 20 | 40 | 3.0 | 20 | 7.6 | 2.4 | 3.7 | 60.0 | 52.0 | 3.05 | 1.94 | 2.24 |
| PRC | 20 | 40 | 40 | 1½ | 20 | 7.6 | 2.4 | 2.5 | 72.4 | 61.1 | 3.04 | 1.61 | 1.90 |
| PRC | 20 | 40 | 160 | 4 | 20 | 7.6 | 2.4 | 1.75 | 70.0 | 62.0 | 2.84 | 1.55 | 1.75 |
| PRC | 20 | 40 | 180 | 4 | 20 | 7.6 | 2.4 | 1.35 | 68.5 | 58.3 | 2.86 | 1.57 | 1.87 |

Under direct current conditions of 20 asf the concentration of ferric ions in the electrolyte was reduced from 7.6 to 6.3 gpl, while an overall current efficiency of 58.5% was obtained. Under a PRC condition of forward and reverse pulse duration of, respectively, 40 sec and 3 sec, and a current density of 20 asf, the ferric ion concentration decreased from 7.6 to 3.7 gpl with a resulting overall current efficiency of 60%. A greater decrease in ferric ion concentration was obtained using reverse current density (40 asf) which doubles the magnitude of the forward current density (20 asf). Using a forward pulse duration respectively of 40, 160 and 180 secs, and a respective reverse pulse duration of 1.5, 4 and 4 secs, resulted in a reduction of ferric ion concentration from 7.6 to respectively 2.5, 1.75 and 1.35 gpl. These conditions were accompanied by a higher current efficiency than that obtained for direct current electrolysis. The overall current efficiency for each of these conditions is respectively, 72.4, 70 and 68.6%. This high efficiency could additionally be attributed to the increased concentration of cupric ions in the immediate vicinity of the electrode, resulting from the high reverse pulse current density.

TABLE II

RESULTS OF ELECTROLYSIS EXPERIMENTS FOR COPPER ELECTROWINNING FROM ELECTROLYTE CONTAINING HIGH CONCENTRATION OF IRON

| Electrolysis | Electrolysis Conditions Current Density(asf) | | Pulse Durations(sec) | | Initial Electrolyte Composition in gpl | | | Ferric Equilibrium | Average Current Eff. for decopperization from | | Average Cell Voltages | Power Consump. in kwh/lb for decopperization from | |
|---|---|---|---|---|---|---|---|---|---|---|---|---|---|
| Type | $I_f$ | $I_r$ | $T_f$ | $T_r$ | Cu | $Fe^{3+}$ | $Fe^{2+}$ | Conc. in gpl | 20 to 1(gpl) | 10 to 1(gpl) | (volts) | 20 to 1(gpl) | 10 to 1(pgl) |
| DC | 20 | — | — | — | 20 | 0 | 10 | 6.0 | 56 | 46.7 | 3.06 | 1.77 | 2.51 |
| PRC | 20 | 20 | 80 | 4 | 20 | 0 | 10 | 1.5 | 74.0 | 66.1 | 2.86 | 1.38 | 1.66 |
| PRC | 20 | 20 | 40 | 2 | 20 | 0 | 10 | 2.1 | 75.3 | 63.2 | 2.85 | 1.44 | 1.73 |
| PRC | 20 | 20 | 20 | 1 | 20 | 0 | 10 | 4.0 | 73.3 | 57.4 | 2.95 | 1.54 | 1.97 |

EXAMPLE II

Electrolyte Containing High Ferrous Ion Concentration

Figure 4:
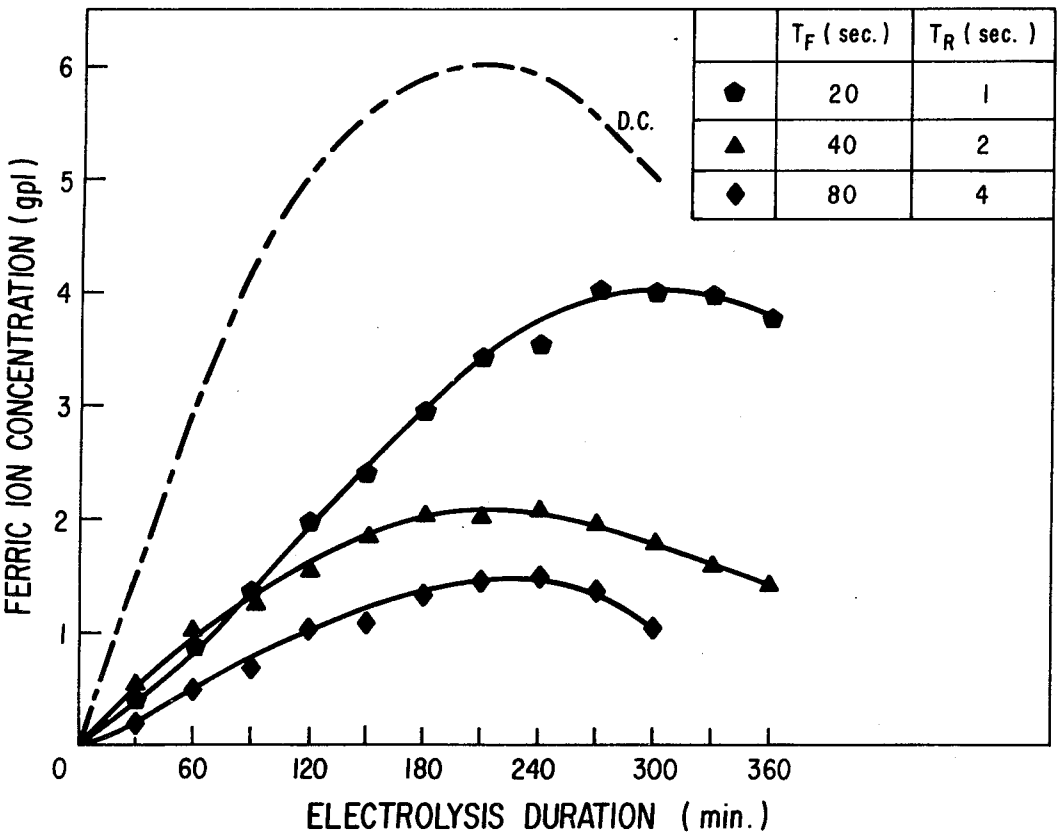
FIG. 4 illustrates the effect of periodic reverse current of varying pulse duration on the formation of ferric ion in an acid copper electrolyte containing an initial concentration of 10 gpl ferrous ions.

Decopperization experiments were also carried out with a solution containing 20 gpl Cu, 10 gpl Fe (as ferrous ions) and about 2 gpl sulfuric acid to assess the effect of PRC electrolysis of various forward and reverse pulse durations at constant cycle efficiency, on the ferrous and ferric ion concentrations and on current efficiency, during decopperization of the electrolyte from 20 to about 1 gpl. The experiment was carried out using a cell similar to Example I. Electrolysis was carried out at a current density of 20 asf for both forward and reverse pulse, a cycle efficiency of 90.5%, an electrolyte temperature of about 30° C. and a circulation rate of 200 ml/min. The results of the experiments are presented in FIGS. 4 and 5 as a variation of ferric ion concentrations with electrolysis duration and of current efficiency as a function of copper concentration. For comparison purposes, the results of an experiment carried out under direct current conditions are also included. The results of FIG. 4 indicate that the application of PRC causes less ferrous ions to be converted to ferric ions at equilibrium and that this effect is more pronounced with the increase in total cycle duration. For forward and reverse pulse durations of, respectively, 20 sec and 1 sec, a maximum concentration of 4 gpl ferric ion is obtained; for forward and reverse pulse durations of, respectively, 40 sec and 2 sec, the maximum concentration of ferric ions is about 2 gpl; for forward and reverse pulse durations of, respectively, 80 sec and 4 sec, this maximum concentration is reduced to 1.5 gpl ferric ion. By comparison, under direct current conditions, a maximum concentration of 6 gpl ferric ion is produced.

The results are also summarized in the following Table II

Figure 5:
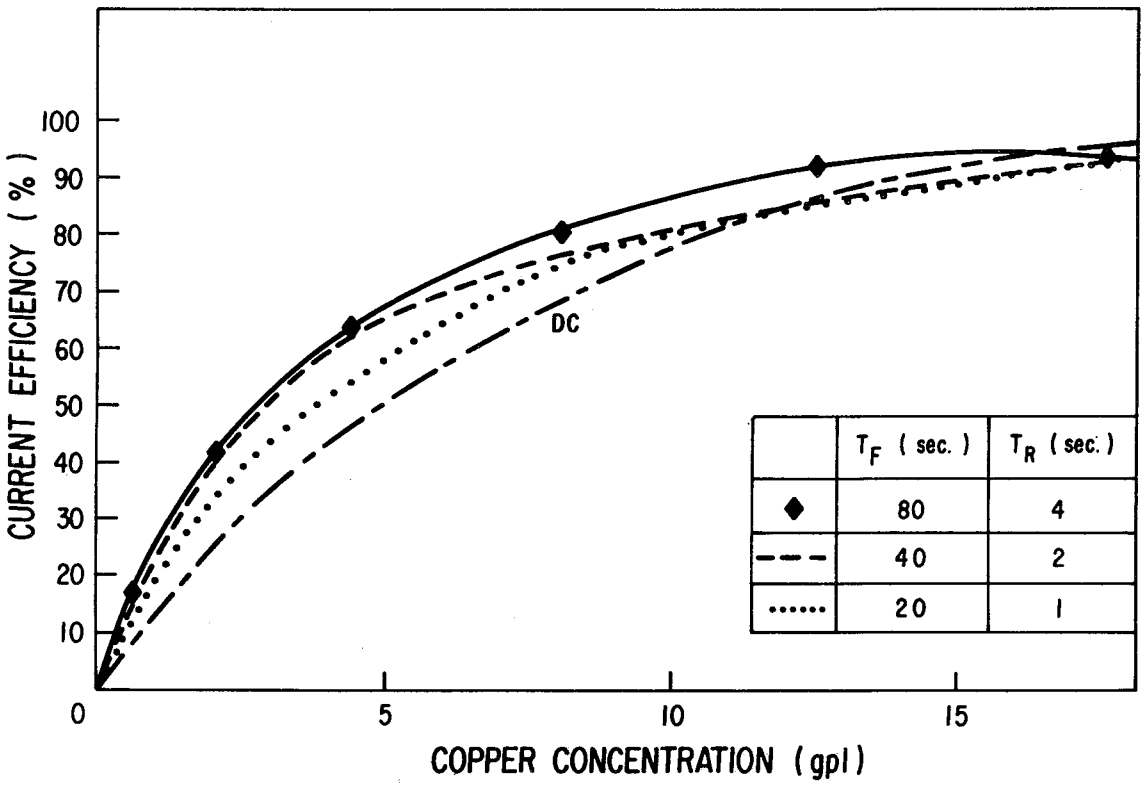
FIG. 5 illustrates the effect of periodic reverse current of various pulse duration on the current efficiency during electrowinning of copper from an electrolyte containing 10 gpl iron.

The results of current efficiency for copper electrowinning as a function of copper concentration (FIG. 5) show that electrolysis under PRC conditions produces a higher overall current efficiency than that obtained under direct current conditions, particularly at copper concentrations below 11 gpl. The current efficiency is also shown to increase with increasing pulse duration reaching a value of 74% overall current efficiency for decopperization from 20 gpl to 1 gpl Cu using forward and reverse pulse durations of, respectively, 80 sec and 4 sec. By comparison, under direct current conditions the overall current efficiency was found to be only 56%. The improvement in current efficiency obtained by application of PRC is shown in FIG. 5 by the area between the D.C. and the respective PRC curves.

2. Continuous Operation

Decopperization of a leach electrolyte was also carried out under continuous operation using a cascade system of cells in which the electrolyte flows through each cell successfully, while being progressively decopperized. A system comprising a series of units, each unit being composed of a certain number of cells in which solution is recirculated at relatively fast flow rate and at constant copper concentration, could also be used.

In order to determine the quality of copper deposits obtained for different levels of copper concentrations in the electrolyte under PRC conditions and at electrolyte temperatures of 50° C., six full height prototype cells have been constructed. Each cell had an overall capacity of 5 liters and dimensions of: length 40 inches, depth 4 inches, and width 2½ inches.

Two lead anodes were mounted on opposite walls of the cells and a copper cathode located centrally to the anodes. The cathodes dimensions were: width 2 inches and full length, as normally used in copper electrorefining or electrowinning operations, of 36 inches. The electrolyte initially containing 20 gpl Cu, 10 gpl Fe (80% in ferric state), 2 gpl Al and 2 gpl sulfuric acid, was cascaded from a reservoir through the cascade of six cells each having an inlet located near the bottom and an overflow outlet at the top. The depleted solution was further collected in a separate reservoir. The temperature of the electrolyte was maintained at about 50° C. using electrical heating elements. The copper, ferrous ion and total iron content, in the solution, were monitored by removing samples near the outlet of each cell at regular time intervals. Electrolysis was carried out under PRC conditions of a forward pulse duration of 180 sec at a current density of 17–18 asf and a reverse pulse duration of 5 sec at a current density of 34–36 asf, and at an electrolyte feed rate of 71.7 ml/min. The results of the experiments are summarized in the following Table III:

TABLE III

RESULTS OF ELECTROLYSIS EXPERIMENTS FOR DECOPPERIZATION OF VAT LEACH SOLUTION USING A SIX CELL CASCADE SYSTEM UNDER PRC CONDITIONS

Electrolyte Temperature 50° C, Initial $Fe^{3+}$ = 8 gpl
Electrolyte Flow Rate = 71.7 ml/min

| Location | $[Fe^{2+}]$ gpl | $[Cu^{2+}]$ gpl | C.E.[1] % | PC[2] kwh/lb | U.C.P.[3] lb/sq ft/day | % of Total Copper Deposited | Quality of Copper |
|---|---|---|---|---|---|---|---|
| Feed | 2.4 | 20.0 | — | — | — | — | — |
| Cell I | 4.2 | 17.7 | 46.0 | 1.89 | .53 | 12.1 | Good |
| Cell II | 5.9 | 14.5 | 66.0 | 1.27 | .73 | 16.7 | Good |
| Cell III | 7.11 | 10.9 | 72.3 | 1.10 | .82 | 18.8 | Good |
| Cell IV | 7.8 | 7.2 | 75.0 | 1.05 | .84 | 19.2 | Good |
| Cell V | 8.5 | 3.6 | 72.3 | 1.08 | .82 | 18.8 | Crystalline Crystalline Powdery |
| Cell VI | 9.5 | 0.83 | 55.0 | 1.50 | .63 | 14.4 | Powdery |
| Overall | | | 65.0 | 1.27 | — | — | |

[1]Current Efficiency
[2]Power Consumption
[3]Unit cell production = number of pounds of copper deposited per unit cathode surface area per day.

The above results indicate that at a flow rate of 71.7 ml/min the desired extent of decopperization from 20 gpl to below 1 gpl Cu could be achieved with an overall current efficiency of 65% for the whole system, with a corresponding power consumption of 1.3 kwh/lb. The slight decrease in the overall current efficiency from the projected value of 68.5% as obtained from the results of the above batch decopperization experiments could be attributed to the lower current density used for this experiment. This observation is in agreement with the results reported in the above mentioned article showing that, in the presence of relatively high concentrations of iron, low cathode current density results in decreased current efficiency for copper electrowinning.

The examination of the quality of the cathode copper deposits at different copper concentration levels indicates that about 68% of the cathode copper deposits obtained from decopperization from 20 gpl to about 0.8 gpl Cu was of good quality. It can generally be concluded from the experiments described above that:

1. the results obtained from the continuous operation experiments regarding current efficiency, power consumption and decopperization levels (20 gpl to 1 gpl Cu) are in agreement with the results obtained from the batch electrolysis experiments, 2. the desired decopperization level from 20 gpl Cu to below 1 gpl Cu at a relatively high current efficiency of 65% and at acceptable power consumption of 1.3 kwh/lb can be achieved using the novel technique of periodic reverse current electrolysis, 3. approximately 68% of the copper electrowon by decopperization from 20 gpl to 1 gpl Cu is of sufficiently good physical quality to be casted directly without the problems associated with handling of powdery metal.

The results obtained by treating directly the leach solution in the above cascade system of six cells have shown that the current efficiency was relatively low in the early stage of decopperization (first two cells). It was observed, by monitoring the ferrous ion concentration, that the largest increases in the ferrous ion concentration coincided with low current efficiencies for copper deposition. This indicated that a significant portion of the electrolysis current was being used to initially reduce the ferric ions to the ferrous form. It could, therefore, reasonably be assumed that if $Fe^{3+}$ was reduced to $Fe^{2+}$ before entering the electrolysis circuit, the current efficiency would be markedly increased. The results of the batch electrolysis experiments reported previously (Table II) have shown that when all the iron present in the solution (about 10 gpl) was converted to the ferrous form the current efficiency, at high copper concentrations (20 gpl), was about 74%. Two methods of reduction of $Fe^{3+}$ to $Fe^{2+}$ may be used. These are the treatment of the pregnant solution with copper powder or with sulfur dioxide.

The first method is based on the fact that copper metal reacts with ferric iron according to the equation $$2Fe^{3+} + Cu^{\circ} \rightarrow 2Fe^{2+} + Cu^{2+} \quad (5)$$

to produce ferrous and copper ions. This method would entail the passage of the feed solution through a bed of copper metal particles before entering the electrolysis cells. The initial concentration of copper in the electrolysis circuit would be proportionately higher. However, this, as shown below, is offset by the increase in the initial current efficiency.

The second method is based on the reaction of sulfur dioxide with ferric iron according to the equation $$SO_2 + 2Fe^{3+} + 2H_2O \rightarrow SO_4^{2-} = 2Fe^{2+} + 4H^{-} \quad (6)$$

where the ferric ions are reduced to the ferrous state with the formation of sulfuric acid in solution. Copper ions are unaffected. The leach solution would be contacted by the sulfur dioxide gas before entering the electrolysis cells, allowing complete reduction of the ferric ions.

Figure 6:
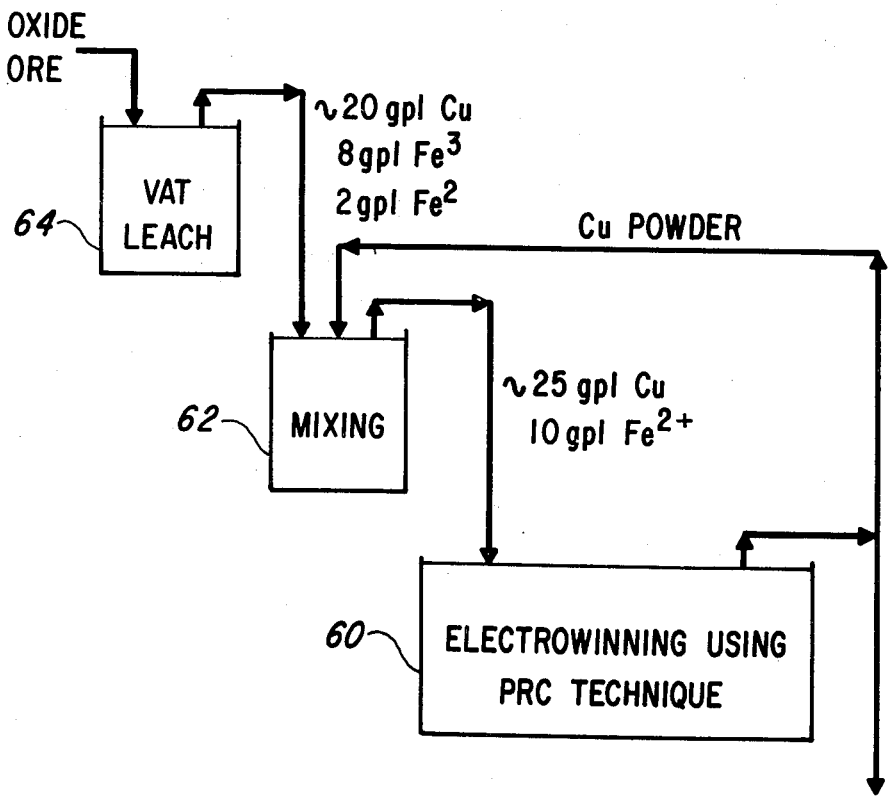
FIG. 6 illustrates a block diagram of a recycling system for copper electrowinning from leach electrolyte solution.

The method based on the reaction with copper powder could advantageously be used by recycling the poor quality copper powder produced at the lower copper concentrations for the treatment of the incoming leach solution. Experiments were thus carried out to determine the effect of reducing the ferric ions with recycled copper powder obtained from the last two cells in the cascade system for copper electrowinning from vat leach solutions. A block diagram of a recycling system is illustrated in FIG. 6 of the drawings. The copper powder produced by PRC electrowinning apparatus 60 is recycled to a tank 62 in which it is mixed with the feed solution containing 20 gpl Cu, 8 gpl $Fe^{3+}$ and 2 gpl $Fe^{2+}$ originating from vat leach tank 64. The output from the mixing tank contains about 25 gpl Cu and 10 gpl $Fe^{2+}$. The copper, ferrous ion and total iron content in the solution were continuously monitored by removing samples from each cell outlet at regular intervals. The electrolysis was carried out under PRC conditions of a forward pulse duration of 180 sec at a current density of 22 asf and a reverse pulse duration of 5 sec at a current density of 34.7 asf, and at an electrolyte feed rate of 64.9 ml/min. The results of these experiments are summarized in the following Table IV:

TABLE IV

RESULTS OF ELECTROLYSIS EXPERIMENTS FOR DECOPPERIZATION OF VAT LEACH SOLUTION USING A SIX CELL CASCADE SYSTEM UNDER CONDITIONS OF PERIODIC REVERSE CURRENT TREATMENT WITH RECYCLED COPPER POWER

Electrolyte Flow Rate - 64.9 ml/min

| Location | $Fe^{2+}$ (g/l) | $Cu^{2+}$ (g/l) | C.E. (%) | P.C. (kwh /lb) | % Total Copper to be deposited Per Cell | % Total Copper to be deposited Cumulative | Quality of Copper |
|---|---|---|---|---|---|---|---|
| Reservoir | 1.93 | 21.44 | — | — | | | |
| Reactor | 9.93 | 25.99 | — | — | | | |
| Cell I | 9.29 | 19.60 | 94.5 | 0.94 | 31.3 | 31.3 | Good |
| Cell II | 8.82 | 14.17 | 81.1 | 1.10 | 26.6 | 57.9 | Good |
| Cell III | 8.56 | 9.02 | 76.9 | 1.08 | 25.2 | 83.1 | Good |
| Cell IV | 7.78 | 6.61 | 72.0 | 0.99 | 11.8 | 94.9 | Good |
| Cell V | 7.62 | 4.61 | 59.8 | 1.21 | 9.8 | 104.7 | Crystalline |
| Cell VI | 8.98 | 1.03 | 53.4 | 1.52 | 17.5 | 122.2 | Powdery |
| Overall Depletion (25 to 1 gpl) | | | 75.7 | 1.09 | | | |
| Overall Performance (including reactor) | | | 60 | 1.38 | | | |

The above results show that for a depletion of copper from 25 gpl to 1 gpl an overall current efficiency of 75.7% was obtained at a power consumption of 1.09 kwh/lb. The ferrous ion concentration decreased from 9.93 gpl to a minimum of 7.62 gpl, then increased to 8.98 gpl. The copper cathodes produced in the first four cells were of relatively good physical quality, while those of the last two cells were of a coarse crystalline and powdery nature. The results of these tests show a marked improvement from those obtained previously at a low initial ferrous ion concentration. For a depletion of 20 to 1 gpl Cu, a current efficiency of 65% and a power consumption of 1.27 l lwh/lb (Table III) were obtained in the presence of ferric ions in the initial solution. It was concluded from these experiments that recycling of the poor quality copper obtained in the last two cells to reduce the ferric ions in the electrolyte feed, would be beneficial to the overall copper electrowinning process from the vat leach solution in that a high output of good quality copper could be obtained at the expense of recycling about 25% of the copper deposited. The overall current efficiency and power consumption obtained using this recirculation system has to be adjusted to take into account the power loss due to recirculation of the copper produced in cells 5 and 6. The adjusted current efficiency and power consumption are respectively, 60% and 1.38 kwh/lb. This represents an increase in power consumption. However, this increase is compensated by the increase in the production of good quality copper from 68%, in the absence of the recycling system, to essentially 100% with recycling.

3. Effect of Electrolyte Temperature

Results of electrolysis experiments carried out at an electrolyte temperature of about 30° C. and at various copper concentrations, have indicated that reasonably good copper deposits could only be obtained for decopperization from 20 gpl to 15 gpl copper. Increasingly powdery deposits were obtained for decopperization of the solution from 15 gpl to 1 gpl copper. Electrolyte temperature is well known to be one of the most important factors in determining the quality of the cathode deposits. Electrolysis experiments were, therefore, carried out to determine the effect of increasing the electrolyte temperature on the overall current efficiency and power consumption for copper electrowinning from vat leach solution. Decopperization tests, from 20 gpl to 1 gpl copper, were performed at 50° C. in the full height cells described previously under periodic reverse current conditions, as well as, for comparison purposes, under direct current conditions. Results of the electrolysis experiments are summarized in the following Table V, together with the results obtained for corresponding experiments carried out at 30° C.

TABLE V

RESULTS OF ELECTROLYSIS EXPERIMENTS FOR DECOPPERIZATION FOR OF LEACH SOLUTION UNDER PRC & DC CONDITIONS

Initial Ferric Conc. = 8 gpl

| Electrolysis Conditions | Electrolyte Temp. ° C | Average C.E. % For Decopperization 20 to 1 gpl Cu | Average C.E. % For Decopperization 10 to 1 gpl Cu | Power Consumption kwh/lb For Decopperization 20 to 1 gpl Cu | Power Consumption kwh/lb For Decopperization 10 to 1 gpl Cu |
|---|---|---|---|---|---|
| DC | 50 | 55.7 | 46.0 | 2.1 | 2.53 |
| | 30 | 58.5 | 50.0 | 1.75 | 2.00 |
| PRC | 50 | 70.5 | 67.6 | 1.30 | 1.35 |
| | 30 | 68.5 | 60.0 | 1.41 | 1.60 |

The results indicate that under PRC electrolysis conditions increasing the electrolyte temperature has a beneficial effect on current efficiency for copper electrowinning in the presence of iron. For decopperization from 20 gpl to 1 gpl Cu and 10 gpl to 1 gpl Cu, respectively, the average overall efficiency increased by 2.0 and 7.6%. On the contrary, under DC conditions, an adverse effect of increasing the electrolyte temperature on the overall current efficiency was observed. The average overall efficiency decreased by 2.8 and 4.0%, respectively, for decopperization from 20 gpl to 1 gpl copper and 10 gpl to 1 gpl copper. Under PRC conditions, copper was deposited evenly over the total cathode length compared to an uneven copper deposition under DC electrolysis conditions. In the latter case, the copper deposited mainly on the bottom half of the cathode. This can be attributed to the faster rate of redissolution of copper on the top half of the cathode due to the presence of high concentrations of oxygen facilitating the oxidation of ferric ions which is enhanced at elevated temperature. This indicates that electrowinning of copper to low copper concentration levels under DC conditions will not be practical at 50° C. and at high concentration levels of ferric ions.

The above results indicate that, under PRC conditions, increasing the electrolyte temperature results in an increase in current and power efficiencies for copper electrowinning and in an improvement in the overall distribution of the cathode deposits.

4. Effect of Current Density

Experiments were carried out to determine the optimum amplitude of forward and reverse currents for the electrowinning of copper from the vat leach solution. Two values of forward current were used: 20 and 22 asf. The reverse current was varied from 30 asf to 44 asf. The results of these experiments carried out for various forward and reverse pulse durations are presented in the following Table VI:

TABLE VI

EFFECT OF THE MAGNITUDE OF FORWARD AND REVERSE CURRENT ON THE CURRENT EFFICIENCY IN THE ELECTROWINNING OF COPPER FROM OXIDE LEACH DESIGN

| Current Density (asf) Forward ($I_f$) | Reverse ($I_r$) | Time (sec) Forward ($T_f$) | Reverse ($T_r$) | C.E. (%) | P.C. kwh/lb | $Fe^{2+}$ (g/l) |
|---|---|---|---|---|---|---|
| 20 | 40 | 180 | 5 | 69.3 | 1.19 | 10.4 |
| 22 | 34.7 | 180 | 5 | 75.7 | 1.19 | 10.2 |
| 22 | 40 | 180 | 5 | 74.0 | 1.11 | 9.6 |
| 22 | 34.7 | 80 | 2 | 70.4 | 1.14 | 10.2 |
| 22 | 44 | 80 | 2 | 69.6 | 1.14 | 10.0 |
| 22 | 34.7 | 180 | 4 | 72.6 | 1.11 | 9.3 |
| 22 | 30 | 180 | 4 | 71.7 | 1.13 | 9.4 |

These results indicate that for a forward pulse duration of 180 sec and a reverse pulse duration of 5 sec, the combination of 22 asf forward current density and 34.7 asf reverse current density produced the highest overall current efficiency, 75.7%. Decreasing the forward current density to 20 asf resulted in a decrease in current efficiency to 69.3%, while an increase in reverse current density to 40 asf showed a decrease in current efficiency to 74%. An increase in reverse current density to 44 asf for a forward and reverse pulse duration of 80 and 2 sec respectively, or a decrease to 30 asf for pulse durations of 180 and 40 sec respectively, resulted in lower values of current efficiency when compared to a reverse current density of 34.7 asf.

5. Effect of Forward and Reverse Pulse Duration

Experiments were carried out to determine the effect of various forward and reverse pulse durations on the current efficiency of copper electrowinning from a leach solution. In this case, a forward current of 22 asf and a reverse current of 34.7 asf were used while the cycle efficiency ($E_c$) was maintained at 93.7%. The results of these experiments are presented in the following Table VII:

TABLE VII

EFFECT OF DURATION OF FORWARD AND REVERSE PULSE ON CURRENT EFFICIENCY IN THE ELECTROWINNING OF COPPER FROM THE VAT LEACH SOLUTION

Cycle Efficiency ($E_c$) - 93.7%
$I_f$ - 22 asf $I_r$ - 34.7 asf

| Duration (secs) $T_f$ | $T_r$ | Electrolyte Feed Rate (ml/min) | C.E. (%) (20-1 gpl Cu) | P.C. (kwh/lb) |
|---|---|---|---|---|
| 80 | 2 | 64.45 | 67.2 | 1.19 |
| 160 | 4 | 64.9 | 74.2 | 1.08 |
| 200 | 5 | 64.5 | 71.5 | 1.11 |

The results indicate a maximum in current efficiency for forward and reverse pulse durations of, respectively, 160 and 4 sec. These results have shown that the optimum forward pulse duration would be 160–200 sec while the optimum duration of the reverse pulse appeared to be 4–5 sec.

6. Effect of Cycle Efficiency

Tests were conducted to determine the effect of various cycle efficiencies on the current efficiency for electrowinning of copper from a leach liquor. As commonly known, the cycle efficiency $E_c$ is calculated from the following equation:

$$(T_f 31\ I_r/I_f T_r)/(T_f + T_r)$$

In one instance a forward pulse duration of 160 sec was selected and the reverse pulse duration was varied from 2 to 5 sec, while in the other case a forward pulse duration of 200 sec was used while varying the reverse pulse duration from 4 to 6 sec. The forward and reverse current densities were, respectively, 22 asf and 34.7 asf. The results of these tests are presented in the following Table VIII:

TABLE VIII

EFFECT OF CYCLE EFFICIENCY ON CURRENT EFFICIENCY IN THE ELECTROWINNING OF COPPER FROM THE VAT LEACH SOLUTION $I_f$ - 22 asf $I_r$ - 34.7 asf

| Duration (secs) $T_f$ | $T_r$ | Cycle Efficiency (%) | Current Efficiency (20-1 gpl Cu) (%) | Power Consumption (kwh/lb) |
|---|---|---|---|---|
| 160 | 2 | 96.8 | 66.0 | 1.15 |
| 160 | 3 | 95.3 | 69.9 | 1.11 |
| 160 | 4 | 93.7 | 74.2 | 1.09 |
| 160 | 5 | 92.2 | 69.8 | 1.15 |
| 200 | 3 | 96.2 | 69.8 | 1.15 |
| 200 | 4 | 94.9 | 70.9 | 1.11 |
| 200 | 5 | 93.7 | 71.5 | 1.11 |

The optimum reverse pulse duration for $T_f$ of 160 sec was observed to be 4 sec (corresponding to a cycle efficiency of 93.7%) for which an overall current efficiency of 74.2% was obtained. In the case of a forward pulse duration of 200 sec, an optimum current efficiency of 71.5% was obtained with a reverse pulse duration of 5 sec. These conditions also correspond to a cycle efficiency of 93.7%. The results indicate that optimum conditions are defined by a cycle efficiency of about 94% with a total cycle duration of 160 sec resulting in higher current efficiency and lower power consumption that a duration of 200 sec.

Although the invention has been disclosed with reference to specific experiments, it is to be understood that it is not limited to the leach solutions, the copper concentrations, iron concentrations and other specific parameters used, but only by the scope of the claims.

The embodiments of the invention in which an exclusive property or privilege is claimed are defined as follows:

1. A process for electrowinning copper from leached solutions containing a high iron concentration in the range of about 5 to 40 gpl by electrodeposition of copper in an electrochemical cell provided with a cathode and an insoluble anode, which comprises applying direct current through the solution in the cell between said cathode and insoluble anode and periodically reversing the polarity of said current to obtain, during electrolysis, a low ferric ion concentration in the solution, thereby increasing the operating current efficiency and consequently decreasing the power consumption for metal deposition.

2. A process as defined in claim 1, wherein the leach solution is a sulphuric acid solution.

3. A process as defined in claim 1, wherein the forward and reverse pulse durations range from 20–200 sec forward and 1–5 sec reverse at a current density of about 10–30 asf in the forward direction and 10–60 asf in the reverse direction.

4. A process as defined in claim 3, wherein the forward and reverse pulse durations are about 160–200 sec and 4–5 sec respectively.

5. A process as defined in claim 4, wherein the forward and reverse current densities are about 15–25 asf and 30–40 asf respectively.

6. A process as defined in claim 5, wherin the forward and reverse pulse durations and the forward and reverse current densities are such that the cycle efficiency is at least about 90%.

7. A process as defined in claim 1, wherein the temperature of the solution is maintained between about 25° C. and 65° C.

8. A process as defined in claim 7, wherein the temperature of the solution is maintained at about 50° C.

9. A process as defined in claim 1, wherein the iron concentration is in a high ferric state and wherein the ferric ion concentration is reduced below 4 gpl during electrolysis by applying said periodic current reversal.

10. A process as defined in claim 1, wherein the iron concentration is in a high ferric state, and wherein the ferric ion concentration is reduced to the ferrous state prior to electrolysis and maintained below 4 gpl ferric during electrolysis by applying said periodic current reversal.

11. A process as defined in claim 10, wherein said reduction of the iron concentration from the ferric state to the ferrous state is done by $SO_2$ addition to the solution.

12. A process as defined in claim 10, wherein said reduction of the iron concentration from the ferric state to the ferrous state is done by copper powder addition to the solution.

13. A process as defined in claim 1, wherein electrowinning is done in a batch operation wherein the solution is recirculated from a reservoir through an inlet located near the bottom of the cell and allowed to overflow from the top of the cell back to the reservoir.

14. A process as defined in claim 1, wherein electrowinning is carried out under continuous flow using a cascade system of cells in which the solution is cascaded from a reservoir through the cascade of cells, each having an inlet located near the bottom and an overflow outlet at the top, the depleted solution being collected in a separate reservoir.

15. A process as defined in claim 1, wherein electrowinning is carried out under continuous flow using a cascade system of cells and wherein the copper powder obtained from the last cells in the cascade system is recycled and mixed with the feed solution to reduce the ferric ions in the solution to the ferrous form prior to electrolysis, said ferric ions being maintained in a low concentration during electrolysis under periodic current reversal conditions.

* * * * *